US011299914B2

(12) United States Patent
Brennan et al.

(10) Patent No.: US 11,299,914 B2
(45) Date of Patent: Apr. 12, 2022

(54) ELECTRIFIED EXIT DEVICE

(71) Applicant: Hanchett Entry Systems, Inc., Phoenix, AZ (US)

(72) Inventors: John Brennan, Phoenix, AZ (US); Larry Gene Corwin, Jr., Mesa, AZ (US); Lawrence Harrell, IV, San Tan Valley, AZ (US); Robert W. Lewis, Tempe, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 100 days.

(21) Appl. No.: 16/549,660

(22) Filed: Aug. 23, 2019

(65) Prior Publication Data

US 2019/0383063 A1 Dec. 19, 2019

Related U.S. Application Data

(62) Division of application No. 15/480,503, filed on Apr. 6, 2017, now Pat. No. 11,035,150.
(Continued)

(51) Int. Cl.
*E05B 65/10* (2006.01)
*E05B 63/18* (2006.01)
(Continued)

(52) U.S. Cl.
CPC ..... *E05B 65/1093* (2013.01); *E05B 47/0657* (2013.01); *E05B 63/18* (2013.01);
(Continued)

(58) Field of Classification Search
CPC ..... Y10T 292/0908; Y10T 292/0909; Y10T 292/091; Y10T 292/11; E05B 65/1093;
(Continued)

(56) References Cited

U.S. PATENT DOCUMENTS 3,730,574 A * 5/1973 Zawadzki ..... E05B 65/1053 292/92
3,935,614 A * 2/1976 Pannone ..... A62C 2/247 16/48.5

(Continued)

OTHER PUBLICATIONS

Oriental Motor, "Everything About Stepper Motors" (May 2017). OrientalMotor.com https://www.orientalmotor.com/stepper-motors/technology/everything-about-stepper-motors.html (Year: 2017).*

(Continued)

*Primary Examiner* — Christine M Mills
*Assistant Examiner* — Faria F Ahmad
(74) *Attorney, Agent, or Firm* — Woods Oviatt Gilman LLP; Dennis B. Danella, Esq.

(57) ABSTRACT

A latch dogging assembly comprises an electromagnet and an actuator mounted on a bracket. A guide slide is pivotally mounted on the bracket with a lead block coupled to the guide slide. A guide pin rides along an inner surface of the bracket causing the guide slide to pivot. A pawl is slidably engaged with the guide slide. A guide link includes a post. An armature is mounted to the panic bar and the post engages the pawl. When the actuator is energized to move the lead block, the pawl engages the post to pivot the armature and thereby cause the panic bar to move from the extended position to the depressed position. When the electromagnet is energized the armature is magnetically held preventing reverse pivoting of the guide link. A method for fully retracting a door latch is also provided.

10 Claims, 11 Drawing Sheets

Related U.S. Application Data

(60) Provisional application No. 62/320,180, filed on Apr. 8, 2016.

(51) Int. Cl.
*E05B 47/06* (2006.01)
*E05B 47/00* (2006.01)
*E05B 47/02* (2006.01)

(52) U.S. Cl.
CPC ..... *E05B 65/108* (2013.01); *E05B 65/1053* (2013.01); *E05B 47/0012* (2013.01); *E05B 47/023* (2013.01); *E05B 65/10* (2013.01); *E05B 65/1046* (2013.01); *Y10T 292/0908* (2015.04); *Y10T 292/0909* (2015.04); *Y10T 292/11* (2015.04)

(58) Field of Classification Search
CPC .. E05B 47/0657; E05B 63/18; E05B 65/1053; E05B 65/108; E05B 65/10; E05B 47/0012; E05B 47/023; E05B 63/0056; E05B 2047/0023; E05B 2047/0016; E05B 2047/0067; E05B 47/00; E05B 47/0001; E05B 65/1046; E05B 43/005; E05B 45/06; E05B 63/0065; E05B 17/0083; E05B 17/22; E05B 41/00; E05B 43/00
See application file for complete search history.

(56) References Cited

U.S. PATENT DOCUMENTS 4,384,738 A 5/1983 Floyd
4,801,163 A 1/1989 Miller et al.
5,823,582 A * 10/1998 Frolov ..... E05B 65/1053 292/92
6,104,594 A 8/2000 Frolov et al.
6,116,661 A * 9/2000 Overbey ..... E05B 65/1053 292/251.5
6,386,597 B1 * 5/2002 Walsh, III ..... E05B 65/1053 292/201
7,469,942 B2 * 12/2008 Whitaker ..... E05B 65/108 292/92
7,536,885 B1 5/2009 Ross et al.
8,182,003 B2 * 5/2012 Dye ..... E05B 47/0012 292/216
8,851,530 B2 * 10/2014 Geringer ..... E05B 65/1046 292/92
9,797,165 B2 * 10/2017 Geringer ..... E05B 65/1053
2008/0012350 A1 1/2008 Condo et al.
2008/0295550 A1 * 12/2008 Schmidt ..... E05B 65/10 70/144
2011/0215599 A1 * 9/2011 Baragano ..... E05B 47/00 292/259 R
2015/0184426 A1 * 7/2015 Arlinghaus ..... E05B 65/1053 292/138
2016/0333621 A1 * 11/2016 Lehner, Jr. ..... E05F 11/54
2017/0102058 A1 * 4/2017 Stephenson ..... F16H 25/2228
2018/0245375 A1 * 8/2018 Arlinghaus ..... E05B 65/108
2019/0161993 A1 * 5/2019 Brennan ..... E05B 63/0056

OTHER PUBLICATIONS

Lawrence, Philip; GB Patent Application No. GB1705726.6, Search Report, dated Sep. 1, 2017, Intellectual Property Office of Great Britain South Wales, Great Britain.
Lawrence, Philip, "Examination Report Letter," dated Jul. 21, 2020, for GB Patent Application No. GB1705726.6, Intellectual Property Office of Great Britain South Wales, Great Britain, 2 pages.
Lawrence, Philip, "Examination Report" dated Jul. 21, 2020, for GB Patent Application No. GB1705726.6, Intellectual Property Office of Great Britain South Wales, Great Britain, 2 pages.
Lawrence, Philip, "Combined Search and Examination Report under Sections 17 and 18(3)," dated Apr. 19, 2021, GB Application No. GB1705726.6, Intellectual Property Office of Great Britain South Wales, Great Britain, 7 pages.

* cited by examiner

ELECTRIFIED EXIT DEVICE

RELATIONSHIP TO OTHER APPLICATIONS AND PATENTS

This application is a divisional of U.S. patent application Ser. No. 15/480,503, filed Apr. 6, 2017, which claims the benefit of U.S. Provisional Patent Application No. 62/320,180, filed Apr. 8, 2016, which are both hereby incorporated by reference in their entirety.

TECHNICAL FIELD

The present invention relates to an exit device for latching a hinged door into a frame; more particularly, to an electrified panic bar configured to selectively "dog" the exit device in an unlocked position; and most particularly, to an electrified panic bar exit device including an electromagnet and an actuator in a modular package, wherein an armature fixed to the panic bar is brought into contact with the electromagnet upon energizing of the actuator and wherein the armature remains in contact with the electromagnet while the electromagnet is energized, thereby dogging the exit device without a need for continued energizing of the actuator to hold the exit device in its unlocked dogged position. Also provided is an actuator control system which compensates for a stalling actuator by monitoring latch or actuator status and selectively changing actuator input parameters (voltage, current or signal frequency) when stalling is sensed in order to complete latch retraction.

BACKGROUND OF THE INVENTION

Existing exit devices include some type of locking element such as a latch bolt, which may be a Pullman style latch bolt. The locking element (referred to generically herein as a "latch") is required to rotate or retract out of the way of the mating locking element to reach a state of being unlocked. The latch may be mounted in a door and the mating locking element (referred to herein generically as a "strike") may be mounted on a door frame, or vice versa.

Exit devices may typically employ what is commonly referred to as a panic bar to enable actuation of the exit device so as to enable door opening. Panic bars allow users to open the door without necessarily requiring the use of their hands. Rather, the user's body can be used to push against the panic bar until the latch is retracted from the strike. Alternatively or additionally, exits devices may also include provision of an electrically actuable latch such that, when the panic bar is pushed, an electric current is supplied to an actuator to withdraw the latch from the strike.

For electrified exit devices, such as those which may also include a panic bar, unlocking is typically achieved by utilizing an electromechanical device using an actuator to draw the latch out of or away from the strike so as to unlock the latch and release the locked door. The electromechanical device may be actuated remotely by an entry card or the like.

Heretofore, the use of a motor actuator, such as a stepper motor, was preferred to draw the latch from the strike because of the extra force provided by the motor as compared to a solenoid. The extra actuating force was needed to overcome internal resisting forces within the device necessary to return the panic bar to its extended position when released. However, stepper motors had drawbacks. Stepper motors are typically very large in size, require numerous interconnected moving parts, and require a large amount of power or current to withdraw the latch from the strike because of the resisting forces. Also, to assure that the latch returns to its locked position if a loss of power occurred, a large return spring would be needed to back-drive the gearing of a stepper motor and to return its actuating shaft to its starting position. Since the return spring opposes the force of the stepper motor needed to draw the latch from the strike, the spring necessitated the use of a larger stepper motor. Further, large amounts of power are required to maintain energizing of the motor while the latch is held in the unlocked dogged position.

What is needed in the art is a simplified exit device, and especially a simplified modular exit device that can fit within a limited amount of functional space within a panic bar exit device wherein the system allows for a lower-powered actuator and enables de-energizing of the actuator while maintaining the panic bar in the dogged position (i.e. maintaining the latch in the unlocked position), thereby improving energy efficiencies of the door exit device.

What is also needed is such a modular device including an actuator and electromagnet that is retro-fitable with a manually operated exit device.

Also needed in the art is a sensor which senses the state of latch retraction when the actuator is energized. If the sensor senses a delayed latch retraction, which may be caused by binding within the door latch system, input parameters to the actuator, such as voltage, current or signal frequency may be adjusted to complete latch retraction in a timely manner.

It is a principal object of the present invention to address these, as well as other, needs.

SUMMARY OF THE INVENTION

Briefly described, a latch dogging assembly is configured in a modular package to be operable within a door latch system. The door latch system is releasably securing a door in a door frame with the door latch system being selectively moveable manually by way of a panic bar from a latched position when the panic bar is in an extended position and the door is secured in the door frame, to an unlatched position when the panic bar is in a depressed position, whereby the door is releasable from the door frame. The latch dogging assembly comprises an electromagnet and an actuator mounted on a bracket and configured to impart linear movement on a lead block when the actuator is energized. A guide slide is pivotally mounted on the bracket with the lead block coupled to the guide slide via a guide pin. The guide pin is configured to ride along an inner surface of the bracket causing the guide slide to pivot. A magnet catch is pivotally mounted to the bracket and coupled to the guide slide, whereby pivoting of the guide slide causes the magnet catch to pivot toward the electromagnet. A pawl is coupled to the lead block and slidably engaged with the guide slide whereby pivoting of the guide slide drives the pawl to a loaded position. A guide link is pivotally mounted to the bracket at a first location and pivotally connected to an armature at a second location and includes a post at a third location. The armature is configured to be mounted to the panic bar and the post is configured to engage the pawl when the pawl is in the loaded position. When the actuator is energized to retract the actuator shaft and lead block, the pawl engages the post to pivot the armature and thereby causes the panic bar to move from the extended position to the depressed position and the door latch system to move from the latched position to the unlatched position. When the electromagnet is energized the armature is magnetically held by the electromagnet thereby preventing reverse pivoting of the guide link such that the panic bar remains in the depressed position and the door latch system remains in the unlatched position. In this "dogged" condition of the panic bar, the actuator may be de-energized.

In an alternate embodiment, a sensor is employed to detect when the magnet catch is in touching contact with the electromagnet. Upon such detection, the actuator retracts the actuator shaft and lead block to pivot the armature into touching contact with the electromagnet and to cause the panic bar to move from an extended position to a retracted position.

A sensor may be utilized for sensing the state of latch retraction upon energizing the actuator. If the sensor senses slippage or stalling of the actuator caused by binding of the door latch, input parameters to the actuator, such as voltage, current or signal frequency, may be adjusted to complete latch retraction.

Numerous applications, some of which are exemplarily described below, may be implemented using the present invention.

BRIEF DESCRIPTION OF THE DRAWINGS

The present invention will now be described, by way of example, with reference to the accompanying drawings, in which.

Figure 1A:
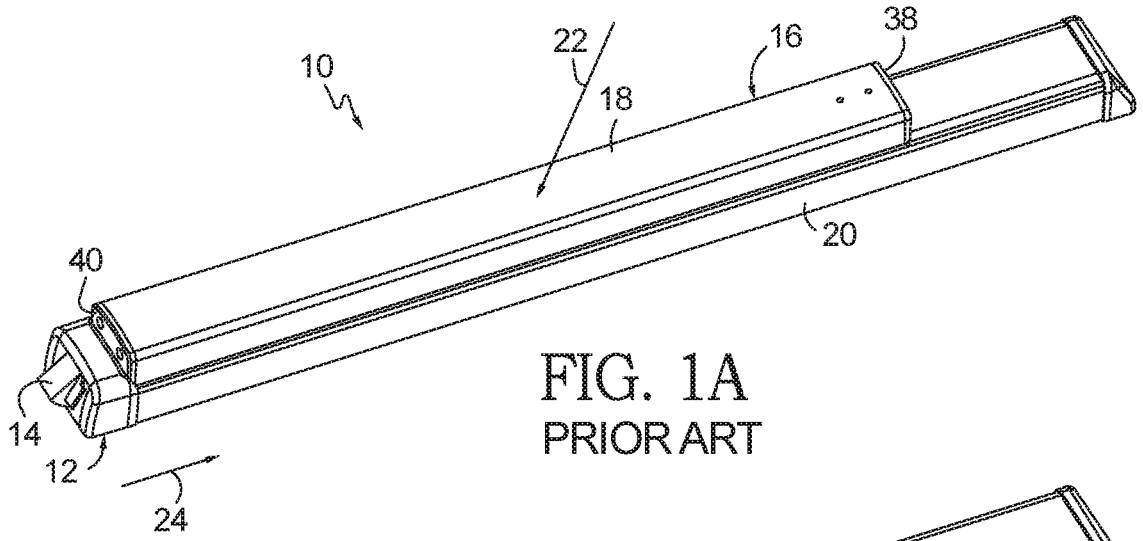
FIG. 1A PRIOR ART
FIG. 1A is a perspective view of a prior art exit device showing the panic bar in the extended position.

Corresponding reference characters indicate corresponding parts throughout the several views. The exemplifications set out herein illustrate currently preferred embodiments of the present invention, and such exemplifications are not to be construed as limiting the scope of the invention in any manner.

DESCRIPTION OF THE PREFERRED EMBODIMENTS

Figure 1B:
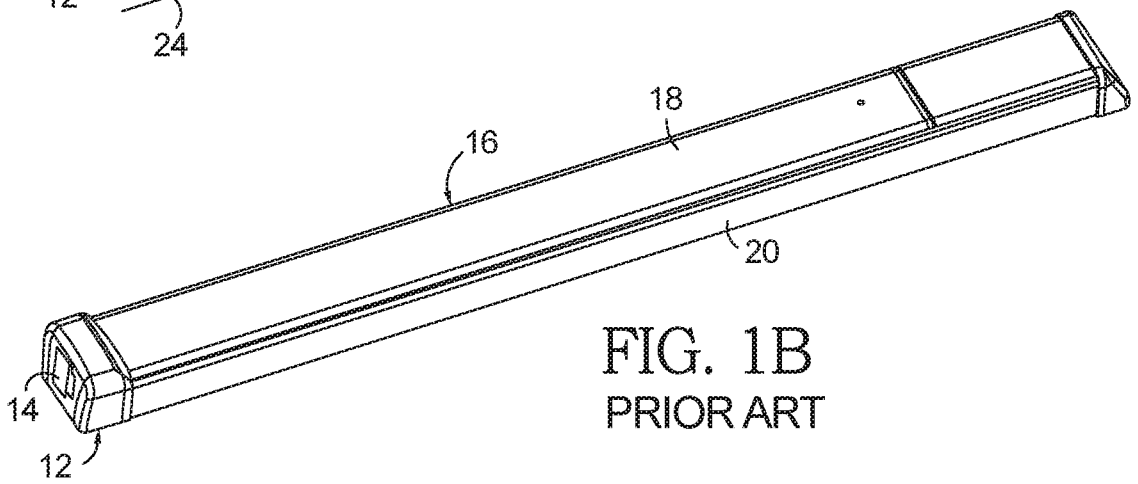
FIG. 1B PRIOR ART
FIG. 1B is a perspective view of the prior art exit device of FIG. 1A showing the panic bar in the depressed, retracted position.
Figure 1C:
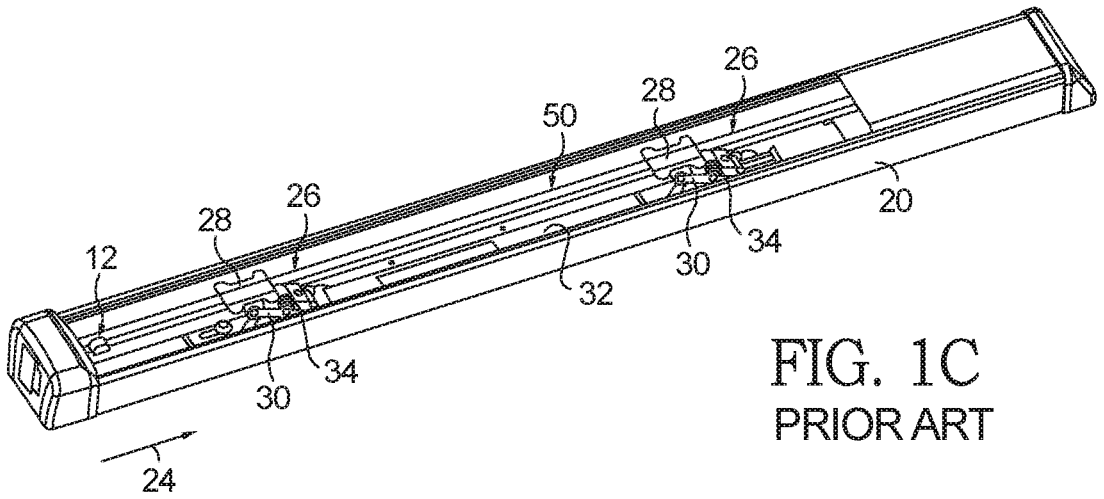
FIG. 1C PRIOR ART
FIG. 1C is a perspective view of the prior art exit device of FIG. 1B showing the panic bar removed.

Referring to FIGS. 1A-1C, non-electrified exit device 10 known in the art may generally include latch mechanism 12 having a latch 14 that is configured to be operatively mounted within a panic bar style actuating mechanism 16 which generally comprises a panic bar 18 secured within a housing 20 which is mounted on a door. Depression of panic bar 18 into housing 20, such as in an actuating direction generally indicated by arrow 22, operates to move latch 14 in an unlocking direction 24 which is generally orthogonal to actuating direction 22 (see FIG. 1A). Such movement causes latch 14 to disengage from a corresponding strike which is secured in a door frame (not shown).

To facilitate depression of panic bar 18 so as to direct latch 14 from the latched position (FIG. 1A) to the unlatched position (FIG. 1B), panic bar 18 may be coupled to one or more actuating members 26 by way of respective actuating bar mounts 28 situated on each actuating member 26. Each actuating member 26 may include a pivoting lever 30 which is coupled to an actuating bar 32 (see FIGS. 1C and 2). Movement of panic bar 18, such as in the actuating direction 22 through manual depression of panic bar 18, pivots pivoting levers 30 thereby causing actuating bar 32 to translate in the unlocking direction 24 and thereby cause latch 14 to withdraw from the strike. Each pivoting lever 30 may further include a biasing member, such as a spring 34, which operates to urge panic bar 18 toward the extended position shown in FIG. 1A wherein latch 14 is in the latched position and configured to engage the strike and secure the door in the door frame. Actuating bar mounts 28 may include opposing flanges 36 (FIG. 2) which are configured to slidably engage with a mating set of tracks located within panic bar 18. Opposing panic bar ends 38, 40 are constrained within housing 20 so as to prevent lateral movement of panic bar 18 during operation (see FIG. 1A). In this manner, panic bar 18 floats within housing 20 and is able to cycle between extended (FIG. 1A) and depressed (FIG. 1B) positions through sliding travel of flanges 36 within the mating set of tracks of panic bar 18. Additionally, panic bar 18 may be removed and replaced by sliding panic bar 18 from actuating bar mounts 28 after removing latch mechanism 12.

It should be noted that, although FIGS. 1A-1C are shown with a Pullman style latch mechanism 12, other style latch mechanisms may be used, such as but not limited to a starwheel latch mechanism, a surface vertical rod latch mechanism, a concealed vertical rod latch mechanism or a mortise style latch mechanism, and that such other and additional latch mechanisms are to be considered part of the present disclosure.

As can be seen by the prior art door exit device 10 shown in FIGS. 1A-1C, latching and unlatching of latch 14 is controlled through the manipulation of actuating mechanism 16 via panic bar 18. When panic bar 18 is depressed, latch 14 is moved to the unlatched position thereby unlocking the door (FIG. 1B). Conversely, once manual pressure to panic bar 18 is removed, springs 34 urge panic bar to its extended position and move latch 14 to its latching position such that reengagement of latch 14 with the strike will secure the door in the frame (FIG. 1A). There are, however, instances where panic bar 18 may be desired to remain in its depressed position and latch 14 to be held in its unlatched position (a condition also referred to as a "dogged" position). A dogged panic bar may allow the door to be freely opened and closed within the door frame without requiring manipulation of the latch mechanism. Thus, there is a need in the art for a latch dogging apparatus configured to hold a door latch in an unlatched position when desired.

Figure 2:
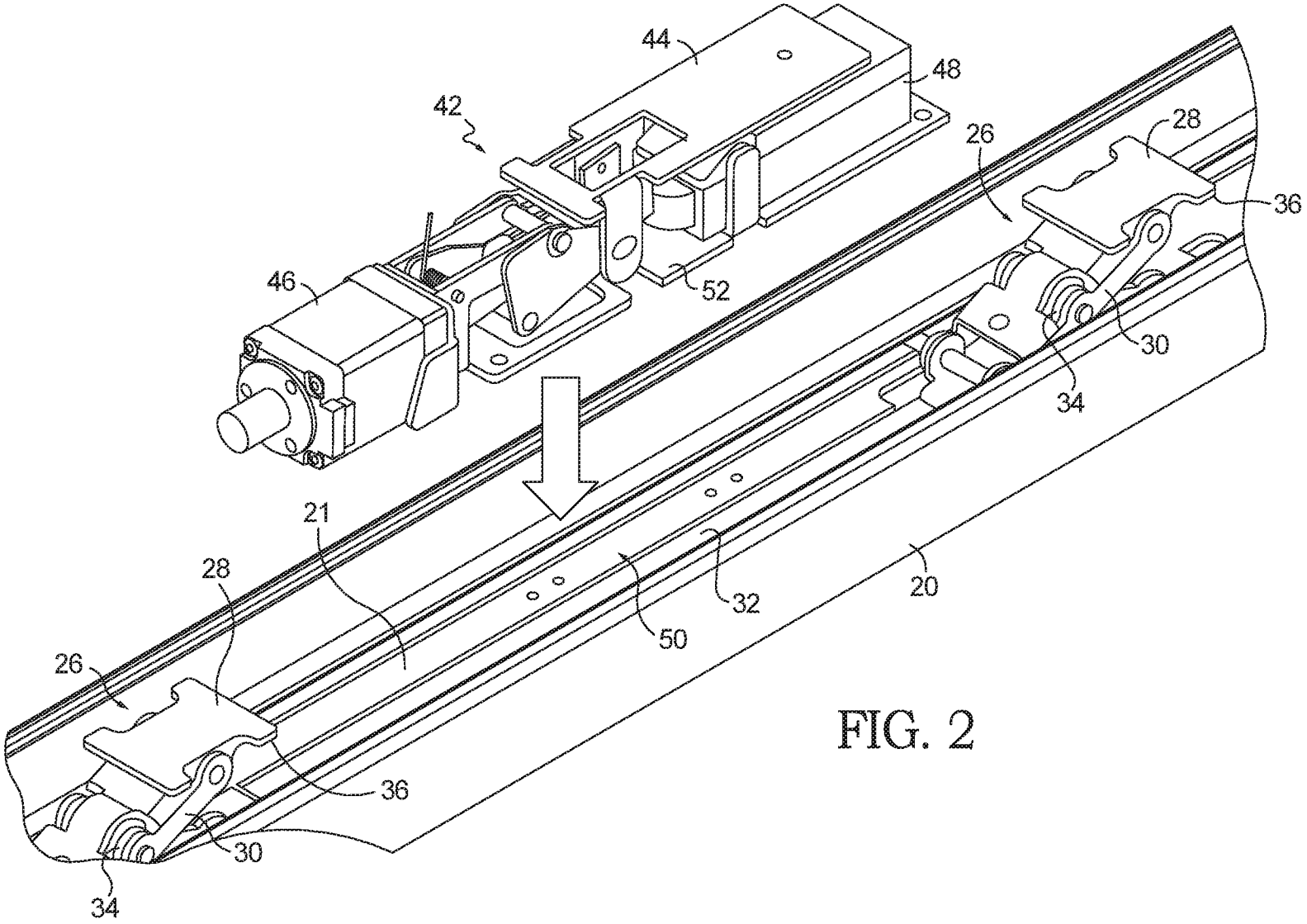
FIG. 2 is a perspective expanded view of a exit device configured for mounting an embodiment of a modular latch dogging assembly in accordance with the present invention.
Figure 3:
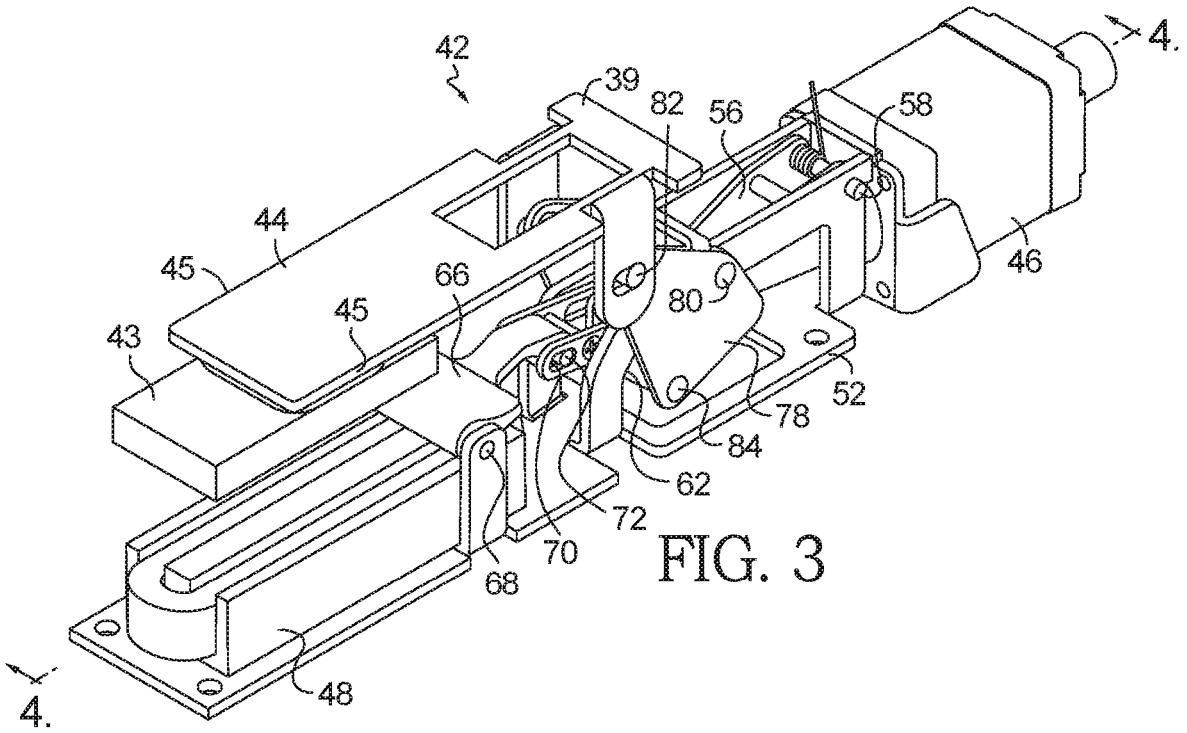
FIG. 3 is a perspective view of a latch dogging assembly in accordance with the present invention.

As shown in FIGS. 2 and 3, an embodiment of an electrified modular latch dogging assembly in accordance with the present invention is generally identified by reference numeral 42. Assembly 42 may be included within newly fabricated manual door exit devices or may be configured for retrofitting an existing manual door exit device to provide electrification to the manual system via an actuator. Modular latch dogging assembly 42 is generally comprised of an armature assembly 44, including armature 43, secured to panic bar 18 (not shown) via opposing flanges 45 of armature support or dogging bar mount 39. Armature assembly 44 is pivotally mounted to an actuator 46 wherein, upon energizing of actuator 46, armature 43 of armature assembly 44 is pivoted toward touching engagement with an electromagnet 48, the mechanism of which will be discussed in greater detail below. The term "starting-parked position" of the actuator means the position in which the actuator's shaft was left following the previous unlocking cycle.

In reference again to FIGS. 2 and 3, armature assembly 44, with flanges 45, may be configured for sliding engagement within the track located on panic bar 18 in which bar mount flanges 36 slidably reside. In this manner, panic bar 18 remains floating within housing 20 as described above. As armature assembly 44 and armature 43 are pivoted toward touching engagement with electromagnet 48 by actuator 46, panic bar 18 is pulled inward in direction 22 (FIG. 1A). At the same time, with the inward movement of panic bar 18, the pivoting of levers 30 by the panic bar movement causes actuating bar 32 to translate in direction 24 (FIG. 1C), thereby withdrawing latch 14 from the strike. Once armature 43 engages electromagnet 48, energizing of electromagnet 48 attracts and holds armature 43 in contact with the electromagnet such that panic bar 18 is maintained in the depressed "dogged" position.

In accordance with the invention, panic bar 18 will be visually depressed and will remain dogged until electromagnet 48 is de-energized irrespective of whether actuator 46 is energized. In this manner, energy efficiency may be improved as power to actuator 46 is only required to pivot armature assembly 44 toward electromagnet 48 and to directly pull panic bar 18 inward to unlatch the latch. While not shown, power to actuator 46 and electromagnet 48 may be through dedicated wires receiving battery or line voltage as is known in the art.

Once electromagnetic attraction between armature 43 and electromagnet 48 has been established, power to actuator 46 may be terminated while a low power current may be supplied to electromagnet 48 to hold the panic bar in a dogged position and to keep latch 14 in the unlatched position. It is envisioned that energizing of actuator 46 and electromagnet 48 may be initiated by a signal generated by a push-button, entry card or other recognition device (none shown). By the manner in which panic bar 18 and electromagnet 48 are oriented, the bar remains dogged (retracted) even if the door or latch dogging assembly is bumped or otherwise impacted.

With continued reference to FIG. 2, in one aspect of the present invention, latch dogging assembly 42 is configured to reside within housing 20 between opposing actuating members 26. It is known in the art that, to facilitate even and controlled depression of panic bar 18, actuating members 26 should be generally mounted an equidistant amount from the opposing ends 38, 40 of panic bar 18. As a result, a void space 50 may be created between the actuating members, with such void space generally centrally located within housing 20 corresponding to the location of panic bar 18. Positioning latch dogging assembly 42 within space 50 operates to place armature assembly 44 and electromagnet 48 within housing 20 at approximately the center of the longitudinal length of panic bar 18. This enables balanced loading of the panic bar when in the dogged state. Latch dogging assembly 42 may include a bracket 52 adapted to secure latch dogging assembly 42 to the bottom wall 21 of housing 20.

Under existing municipal or building codes, only a prescribed minimal amount of pressure exerted on panic bar 18 is allowed in order to drive latch 14 to the unlatched position. In accordance with the invention, meeting this requirement is accomplished through the mechanical advantage developed by the particular design of the linkage of actuating members 26. Thus, since dogging is achieved by acting directly through the actuating members, a smaller and/or less powerful electromagnet 48 may be used to hold the panic bar in its dogged position. This smaller and/or less powerful electromagnet provides improved energy savings while also maximizing space availability within void area 50 of housing 20.

Moreover, in the prior art, when electrification of a manual panic bar mechanism is achieved, the motor actuator is generally configured to act directly on actuating bar 32. In doing so, the motor actuator must be sized to overcome not only the combined opposing forces of friction, springs and other components built into the entire latch mechanism, but also to overcome the motor actuator's return spring that is needed to return its shaft to a starting position in the event of a power outage. In contrast, in accordance with the invention, a smaller motor actuator may be used to retract the latch since the motor actuator is configured to: (1) act directly upon actuating members 26 through the interconnection of the actuating members with dogging bar mount 39, and (2) the motor actuator does not require a shaft return spring. Thus, by being operatively connected to and acting directly upon the actuating members 26 instead of being operatively connected to and acting directly upon actuating bar 32, the better mechanical advantage offered by the actuating members 26 (and the lack of a return spring) allows a smaller, lighter and more energy efficient motor/actuator 46 to be used.

Figure 4:
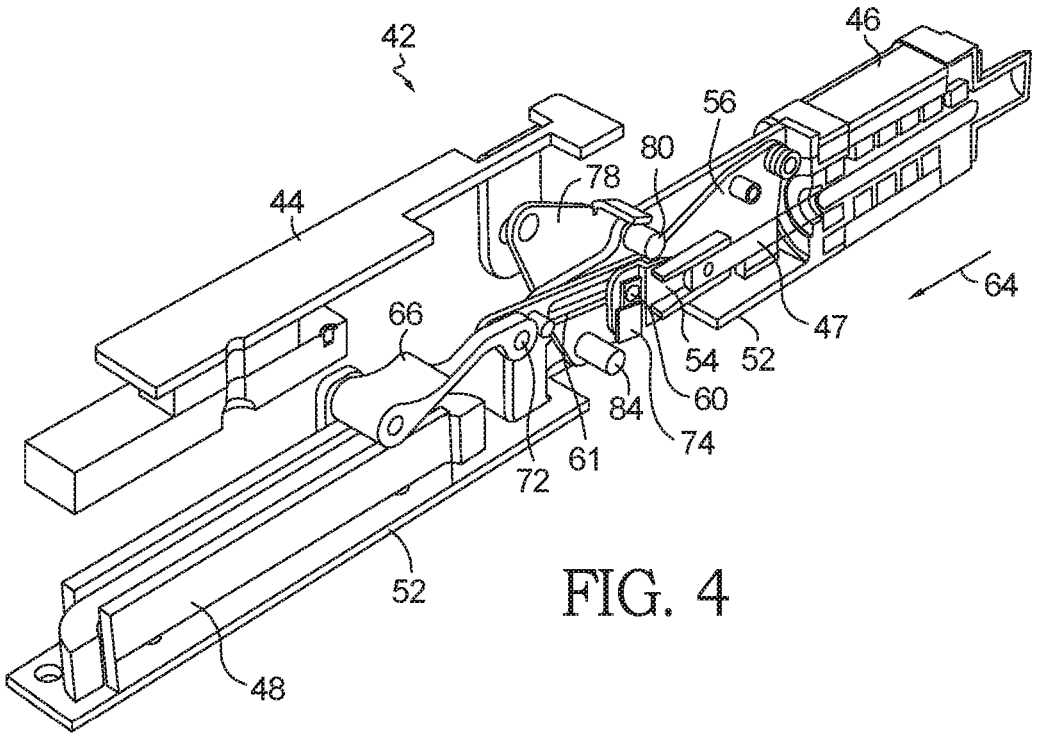
FIG. 4 is a cross-sectional view of the latch dogging assembly taken generally along line 4-4 in FIG. 3.

Referring now to FIGS. 3 and 4, FIG. 3 shows a perspective view of an embodiment of a latch dogging assembly 42, while FIG. 4 is a cross section view thereof. Latch dogging assembly 42 generally comprises electromagnet 48 and actuator 46 mounted on bracket 52. Actuator 46 includes a shaft 47 that is configured to impart linear movement on a lead block 54 when the actuator is energized. A guide slide 56 is pivotally mounted on bracket 52 by a guide pivot pin 58. Lead block 54 is coupled to guide slide 56 via a guide pin 60. Guide pin 60 is configured to ride within a guide slot 61 defined within guide slide 56 and along an angled inner surface 62 of bracket 52 when actuator 46 is energized and moving lead block 54 in a first direction 64. Movement of lead block 54 in first direction 64 causes guide slide 56 to pivot about guide pivot pin 58 as will be discussed in greater detail below. A magnet catch 66 is pivotally mounted to bracket 52 at catch pivot pin 68 on one end and rides within catch slot 70 defined by guide slide 56 via catch pin 72 at the other. As will be described in greater detail below, pivoting of guide slide 56 causes magnet catch 66 to pivot toward touching engagement with electromagnet 48. A pawl 74 is coupled to lead block 54 via guide pin 60 where guide pin 60 further resides within pawl slot 76 defined by lead block 54 (see FIGS. 5-8C). As a result, pawl 74 is slidably engaged with guide slide 56 whereby pivoting of guide slide 56 drives pawl 74 downward to a loaded position (see FIGS. 7A-7C). A guide link 78 is also pivotally mounted to bracket 52 via a link pivot pin 80. Guide link 78 is further pivotally connected to dogging bar mount 39 at armature pin 82. A post 84 is mounted within guide link 78 and is configured to engage pawl 74 when pawl 74 is in the loaded position as will be described in greater detail below.

In the discussion that follows, the term "unlocking cycle" means a complete cycle of the dogging assembly starting from the starting-parked position of the actuator with the actuator and electromagnet de-energized continuing through when the dogging assembly is dogged, and ending at the starting-parked position of the actuator. The term "dogging portion of the unlocking cycle" means the portion of the unlocking cycle starting from the starting-parked position of the actuator with the actuator and electromagnet de-energized and ending when the dogging assembly is dogged. The term "dogging release portion of the unlocking cycle" means the portion of the unlocking cycle starting from when the electromagnet is de-energized from a dogged position and ending at the starting-parked position of the actuator with the actuator and electromagnet de-energized.

Figure 5:
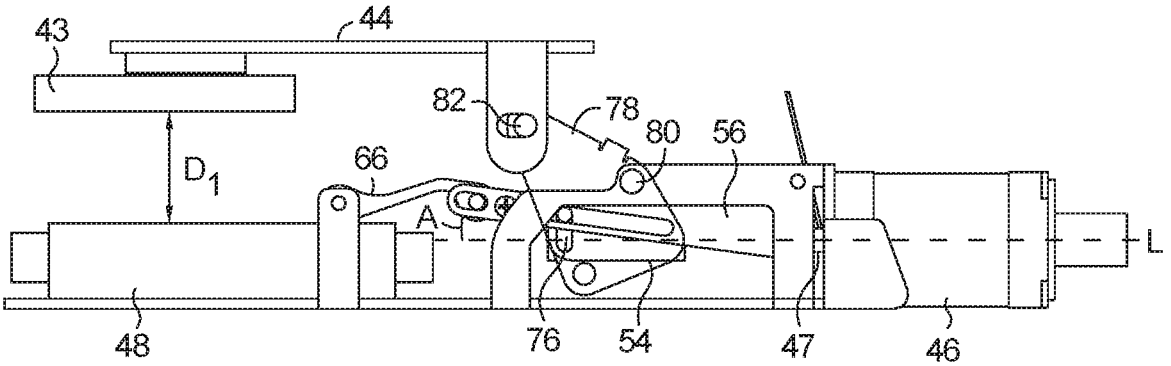
FIG. 5 is a side view of the latch dogging assembly shown in FIG. 3 with the assembly in its parked (bar extended) position.

In a first embodiment of the invention, FIG. 5 shows latch dogging assembly 42 in a starting-parked position. Electromagnet 48 is not energized and panic bar 18 is in its extended position thereby placing latch 14 in its extended, latched position so as to secure the door in the door frame. In this first embodiment, shaft 47 is positioned between a fully extended position and a fully retracted position. Note that guide link 78 is shown in phantom in FIGS. 5-8C so as to enable viewing of internal components such as lead block 54 and guide pin 60. Also note that guide slide 56 is disposed at an angle A with respect to the longitudinal axis L of actuator 46 and shaft 47. Because guide slide 56 is disposed at an angle, magnet catch 66 is pivoted away from electromagnet 48 while pawl 74 is held in its rest position. As described above, armature assembly 44 is slidably coupled to panic bar 18 such that when panic bar 18 is in its extended position armature 43 is spaced apart from electromagnet 48 by a distance $D_1$. In accordance with an aspect of the present invention, distance $D_1$ is selected to be substantially equal to the travel distance of panic bar 18 when moved in actuating direction 22 such that, when latch 14 is fully retracted when moving in unlocking direction 24, armature 43 is in touching contact with electromagnet 48.

Figure 6:
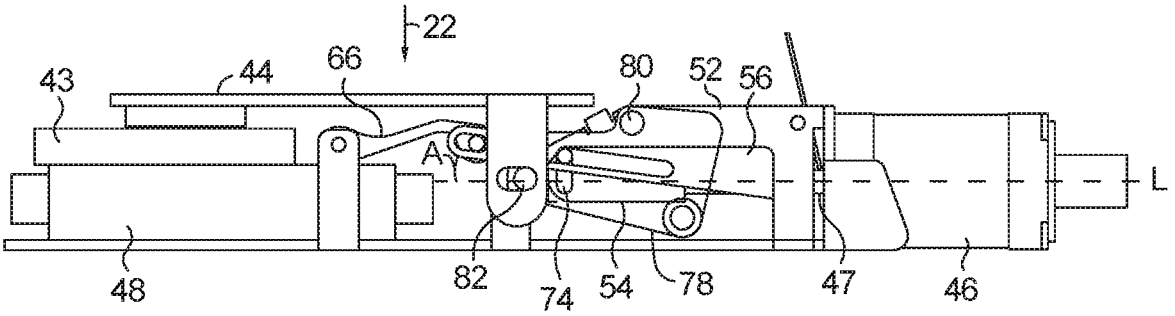
FIG. 6 is a side view of the latch dogging assembly shown in FIG. 3 with the assembly in the depressed position due to manual actuation.

FIG. 6 shows latch dogging assembly 42 upon full manual actuation of panic bar 18 in actuating direction 22 from the state described above and as shown in FIG. 5. Actuation of panic bar 18 directs armature 43 in touching contact with electromagnet 48 via armature assembly 44 engaging armature pin 82 so as to pivot guide link 78 about link pivot pin 80 secured to bracket 52. At the same time, unlatching of latch 14 may be accomplished by pivoting of pivot levers 30 through simultaneous movement of actuating bar mounts 28 by panic bar 18 when moved in direction 22. Note that guide link 78 is able to pivot independently from guide slide 56 and actuator 46. As a result, guide slide 56 remains disposed at angle A with respect to the longitudinal axis L of actuator 46 and shaft 47 and actuator 46 and electromagnet 48 remain unpowered.

Figure 7A:
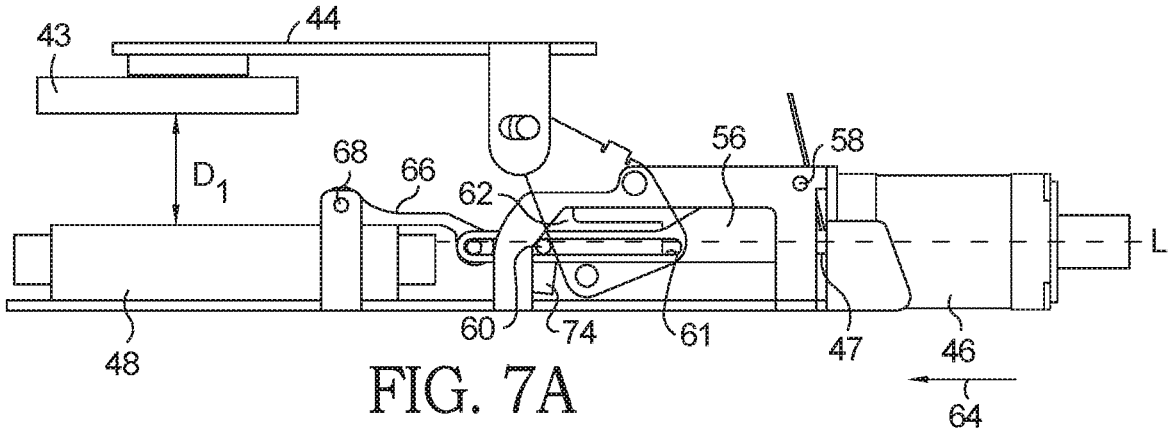
FIG. 7A is a side view of the latch dogging assembly shown in FIG. 3 with the electromagnet energized and the magnet catch in the engaged position with the lead block fully extended.
Figure 7B:
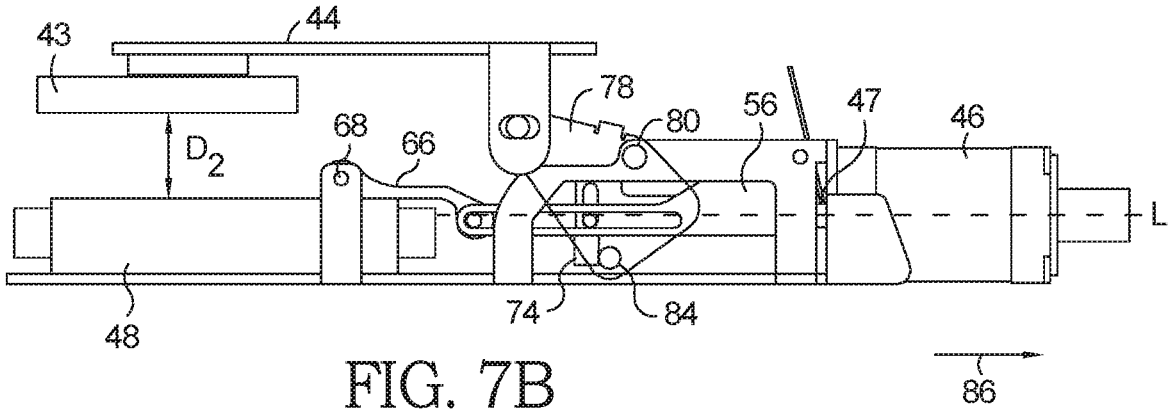
FIG. 7B is a side view of the latch dogging assembly shown in FIG. 3 with the electromagnet energized and the magnet catch in the engaged position with partial retraction of the lead block.
Figure 7C:
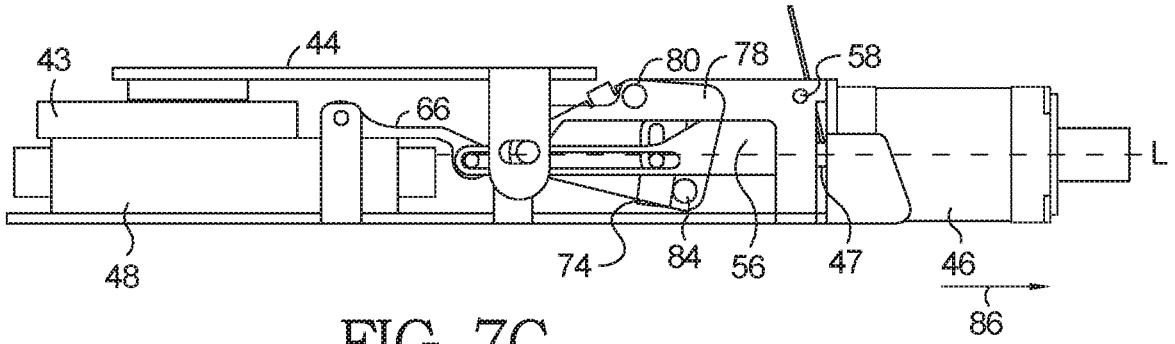
FIG. 7C is a side view of the latch dogging assembly shown in FIG. 3 with the electromagnet energized and the magnet catch in the engaged position with full retraction of the lead block and the assembly in its dogged position.

FIGS. 7A-7C are sequential views of the dogging portion of an unlocking cycle of the first embodiment of latch dogging assembly 42 moving from its starting-parked position as shown in FIG. 5 through full retraction of latch 14 by actuator 46 and dogging of the panic bar by electromagnet 48. As shown in FIG. 7A, actuator 46 has been energized in a first step to initially advance shaft 47 and lead block 54 some distance from their intermediate position shown in FIG. 5, in a first direction 64. Advancement of lead block 54 causes guide pin 60 to ride along an angled inner surface 62 of bracket 52 so as to urge guide slide 56 to pivot about guide pivot pin 58 such that guide slide 56 and guide slot 61 become generally parallel to longitudinal axis L of actuator 46 and shaft 47. As a result, magnet catch 66 pivots about catch pivot pin 68 to place magnet catch 66 in touching contact with electromagnet 48. Upon energizing actuator 46 in the first step, shaft 47 and lead block 54 are advanced in first direction 64, pawl 74 is also directed to its loaded position. In accordance with an aspect of the present invention, electromagnet 48 is energized concurrently with, or slightly after, energizing of actuator 46. Energizing of electromagnet 48 generates a magnetic field which attracts and holds magnet catch 66 in touching contact with the electromagnet so long as sufficient holding current is supplied to electromagnet 48.

Following energizing of actuator 46 to advance shaft 47 (with electromagnet 48 being energized) as described above with reference to FIG. 7A, actuator 46 then reverses direction so as to retract shaft 47 and lead block 54 in second direction 86, as shown in FIGS. 7B and 7C and to complete full retraction of the latch and the dogging portion of the unlocking cycle. With particular reference to FIG. 7B, electromagnet 48 remains energized such that magnet catch 66 remains pivoted about catch pivot pin 68 thereby holding magnet catch 66 in touching contact with the electromagnet. Magnet catch 66 prevents reverse pivoting of guide slide 56 about guide pivot pin 58 such that guide slot 61 remains generally parallel to longitudinal axis L of actuator 46 and shaft 47. Pawl 74 also remains in the loaded downward position where it can engage post 84. As shaft 47 and lead block 54 continue to retract in second direction 86, pawl 74 drives against post 84 so as to cause guide link 78 to pivot about link pivot pin 80. Pivoting of guide link 78 in turn causes armature 43 of armature assembly 44 to move toward electromagnet 48 (i.e. through intermediate distance $D_2$ as shown in FIG. 7B) until armature 43 is in touching contact with electromagnet 48 (FIG. 7C). As electromagnet 48 is already energized, armature 43 is magnetically attracted to and coupled with the electromagnet 48 so as to hold armature assembly 44 (and panic bar 18 which is coupled thereto) in the fully depressed position (FIG. 7C). So long as electromagnet 48 is energized, latch 14 will remain in the unlatched position and the door will be freely movable within the door frame without requiring actuation of latch mechanism 12. Moreover, as the attraction between electromagnet 48 and armature 43 maintain latch 14 in the unlatched position, actuator 46 may be de-energized, thus improving energy efficiency as a small maintenance current is needed to energize the electromagnet while the larger current needed to power the actuator to hold the latch in the unlatched position is no longer required. Note also that, with armature 43 remaining in contact with and attracted to electromagnet 48, the panic bar remains in its depressed position thereby providing a visual confirmation that the latch mechanism is in its dogged state.

Figure 8A:
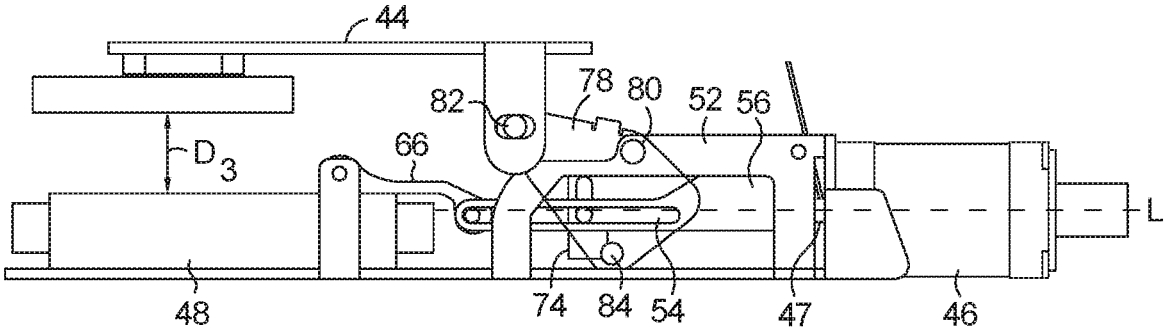
FIG. 8A is a side view of the latch dogging assembly shown in FIG. 3 with the electromagnet de-energized, the armature decoupled and the magnet catch still in the engaged position.
Figure 8B:
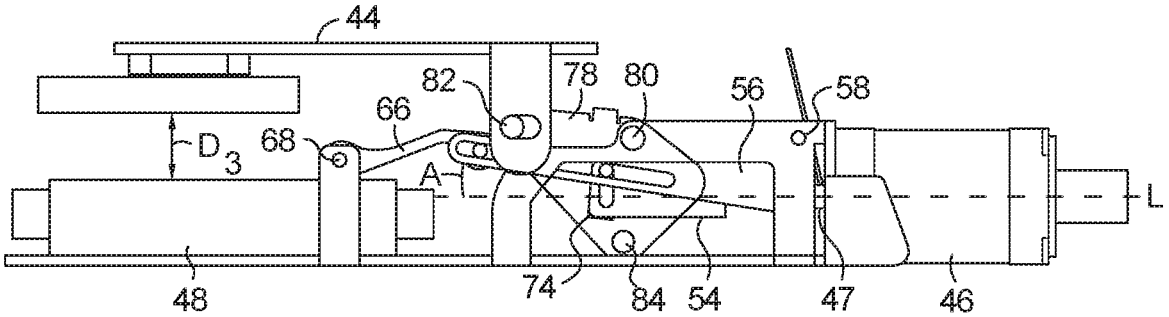
FIG. 8B is a side view of the latch dogging assembly shown in FIG. 3 with the electromagnet de-energized and the magnet catch and armature decoupled.
Figure 8C:
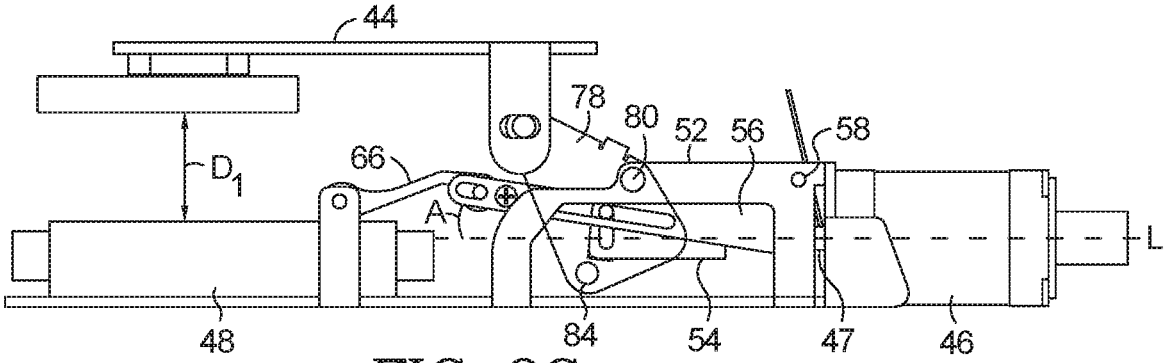
FIG. 8C is a side view of the latch dogging assembly shown in FIG. 3 with the actuator shaft in an intermediate position.

FIGS. 8A-8C are sequential views of the dogging release portion of an unlocking cycle of latch dogging assembly 42 upon de-energizing of electromagnet 48 so as to return armature assembly 44 from its engaged position with electromagnet 48 as shown in FIG. 7C to the starting-parked position of the actuator. As seen in FIG. 8A, de-energizing electromagnet 48 releases armature 43 where guide link 78 is free to pivot about link pivot pin 80 until post 84 contacts pawl 74 and thereby forms an intermediate gap having a distance $D_3$. De-energizing electromagnet 48 also enables magnet catch 66 to disengage from electromagnet 48 and pivot about catch pivot pin 68 (see FIG. 8B). Pivoting of magnet catch 66 reverse pivots guide slide 56 about guide pivot pin 58 such that guide slide 56 returns to its rest position where it is disposed at an angle A with respect to the longitudinal axis L of actuator 46 and shaft 47. Reverse pivoting of guide slide 56 also causes pawl 74 to return to its resting position from its loaded position. As shown in FIG. 8C, with pawl 74 in its resting position, post 84 is free to pivot past pawl 74 so as to return armature assembly 44 (and panic bar 18) to the fully extended position (an armature/electromagnet distance $D_1$). With panic bar 18 in its fully extended position, latch 14 returns to its latched position wherein latch 14 may engage the strike and secure the door in the door frame as described above. Reverse pivoting of guide slide 56 may also be urged by springs 34 (see FIG. 2) as panic bar 18 is coupled to both armature assembly 44 (and therefore latch dogging assembly 42 as described above) and actuating members 26 and de-energizing electromagnet 48 frees actuating members 26 to pivot and return panic bar 18 to its extended position.

In a second embodiment, performance of the first step (advancing shaft 47 and lead block 54 in a first direction 64) to assure that magnet catch 66 is placed in touching contact with electromagnet 48 may be eliminated. This first step is needed in first embodiment 42 since the starting-parked position of shaft 47 may vary somewhat following completion of the previous unlocking cycle (for example, a power outage while the actuator was energized may have occurred before shaft 47 is fully extended.

Figure 5A:
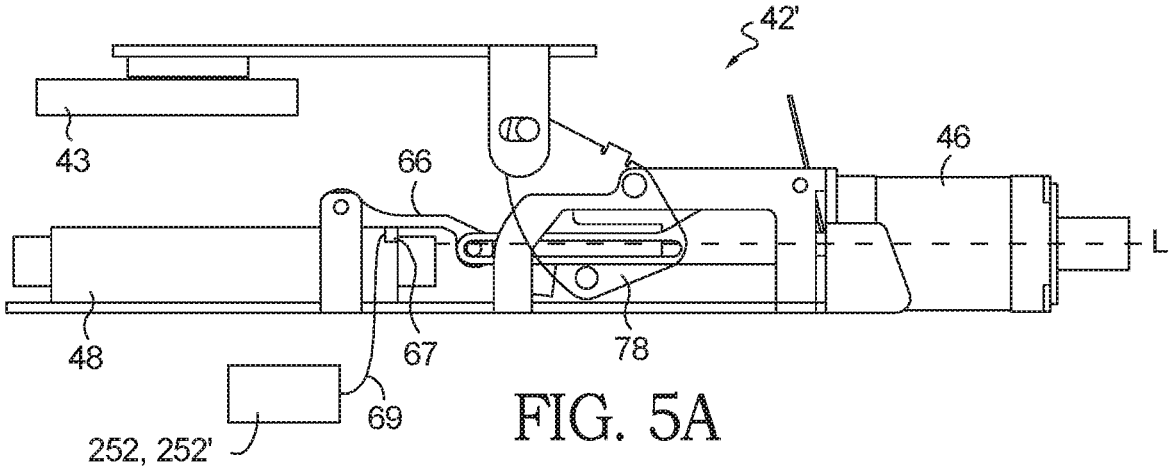
FIG. 5A is a side view of an alternate embodiment of a latch dogging assembly with the assembly in its parked (bar extended) position.
Figure 6A:
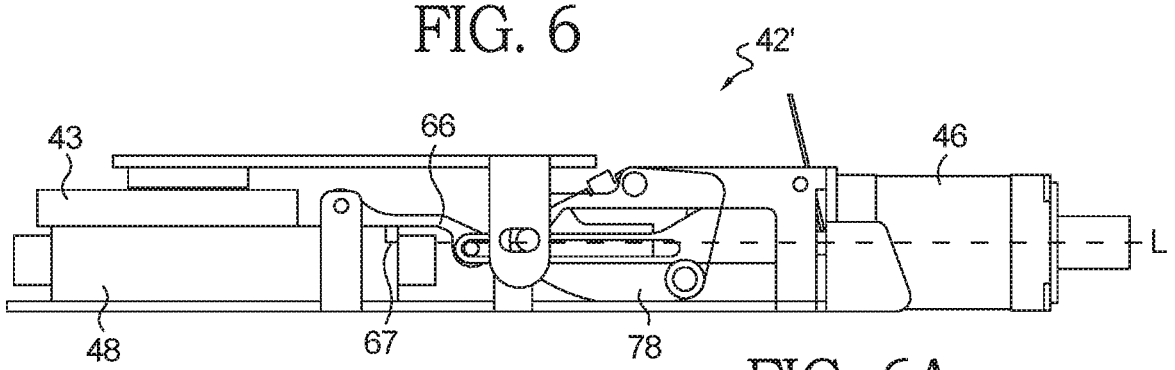
FIG. 6A is a side view of the alternate embodiment of the latch dogging assembly shown in 5A with the assembly in its depressed position due to manual actuation.

Referring to FIG. 5A, latch dogging assembly 42' of the second embodiment is shown wherein assembly 42' is in a starting-parked position with shaft 47 fully extended. Sensor 67, which may be for example a Hall Effect sensor or a mechanical switch, may be positioned in the vicinity of magnet catch 66 to sense that catch 66 is in touching contact with electromagnet 48 or that it is not in touching contact with electromagnet 48, and to provide a signal 69 to controller 252, 252' confirming that touching contact has occurred or has not occurred. From the starting parked position shown in FIG. 5A, with electromagnet 48 energized and upon receipt of signal 69 by controller 252,252' that touching contact is sensed, controller 252, 252' causes shaft 47 and lead block 54 to retract as shown in FIGS. 7B and 7C, skipping the first step of the first embodiment to complete the dogging portion of an unlocking cycle. Upon receipt of signal 69 by controller 252, 252' that a non-touching contact is sensed (i.e., shaft 47 left in an intermediate position following a power outage), controller 252, 252' may momentarily cause actuator to fully extend shaft 47 and lead block 54 as in FIG. 7A to place magnet catch 66 in touching contact with electromagnet 43 before proceeding to retract shaft 47 and lead block 54 in second direction 86 as shown in FIGS. 7B and 7C in order to complete the dogging portion of an unlocking cycle. With the second embodiment, under normal conditions, performance of the first step would not be needed since shaft 57 and lead block 64 would have been left in its fully extended position as shown in FIG. 5A following completion of the previous cycle. Thus, under normal conditions, reaction time between when a command is given to begin an unlocking and when the dogging portion of the unlocking cycle is completed is reduced. FIG. 6A is similar to FIG. 6, showing the latch dogging assembly 42' upon full manual actuation of panic bar 18 in actuating direction 22 from the state described above and as shown in FIG. 5A.

Latch dogging assembly 42, 42' may also include a sensor to interrogate the position and/or magnetic force between armature 43 and electromagnet 48. The sensor may be a Hall Effect sensor or circuitry that measures coil current as a function of magnetic bonding strength. Should magnetically coupling between the armature and electromagnet be sensed, the door locking mechanism would interpret such data to indicate that latch 14 is in the unlatched position. Moreover, as mentioned above, the magnetic coupling of the armature and electromagnet may provide a visual indicator that the latch is in the unlatched position (i.e. the panic bar is visually seen to be in the retracted position), instead of having to manipulate the door to determine whether the assembly is dogged.

Figure 9:
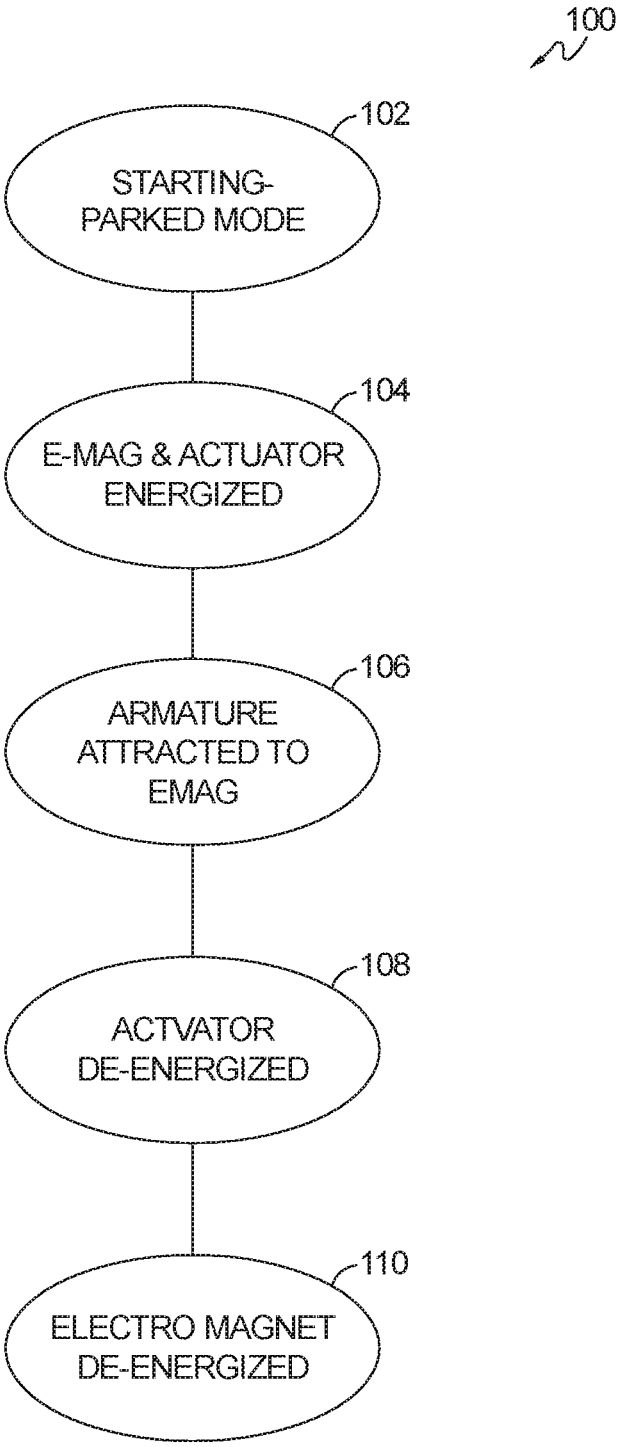
FIG. 9 is a flow chart depicting a method for completing an unlocking cycle in accordance with the invention.

Referring to FIG. 9, a method 100 for completing an unlocking cycle of dogging assembly 42 is shown. In a first step 102 (starting-parked mode), the actuator 46, such as a stepper motor, and electromagnet 48 are both de-energized and latch 14 is in its extended position following completion of a previous unlocking cycle. In a next step 104, electromagnet 48 is energized and actuator 46 is energized to cause actuator shaft 47 to move in a first extending direction through a first sequence to cause a magnet catch to come in contact with and be magnetically attracted to the electromagnet. In a next step 106, the actuator shaft is caused to move in a retracting direction through a second sequence whereby armature 43 is brought in contact with and is magnetically attracted to the electromagnet causing latch 14 to be retracted. In a next step 108, actuator 46 is de-energized, returning shaft 47 and lead block 54 to their starting-parked position while electromagnet 48 remains energized to maintain engagement of the dogging mechanism. At this point, the dogging portion of an unlocking cycle is completed. In a next step 110, electromagnet 48 is de-energized releasing armature 43 and returning latch 14 to its extended position. At this point, the full unlocking cycle is completed and latch 14 is returned to its latched, extended position.

Figure 9A:
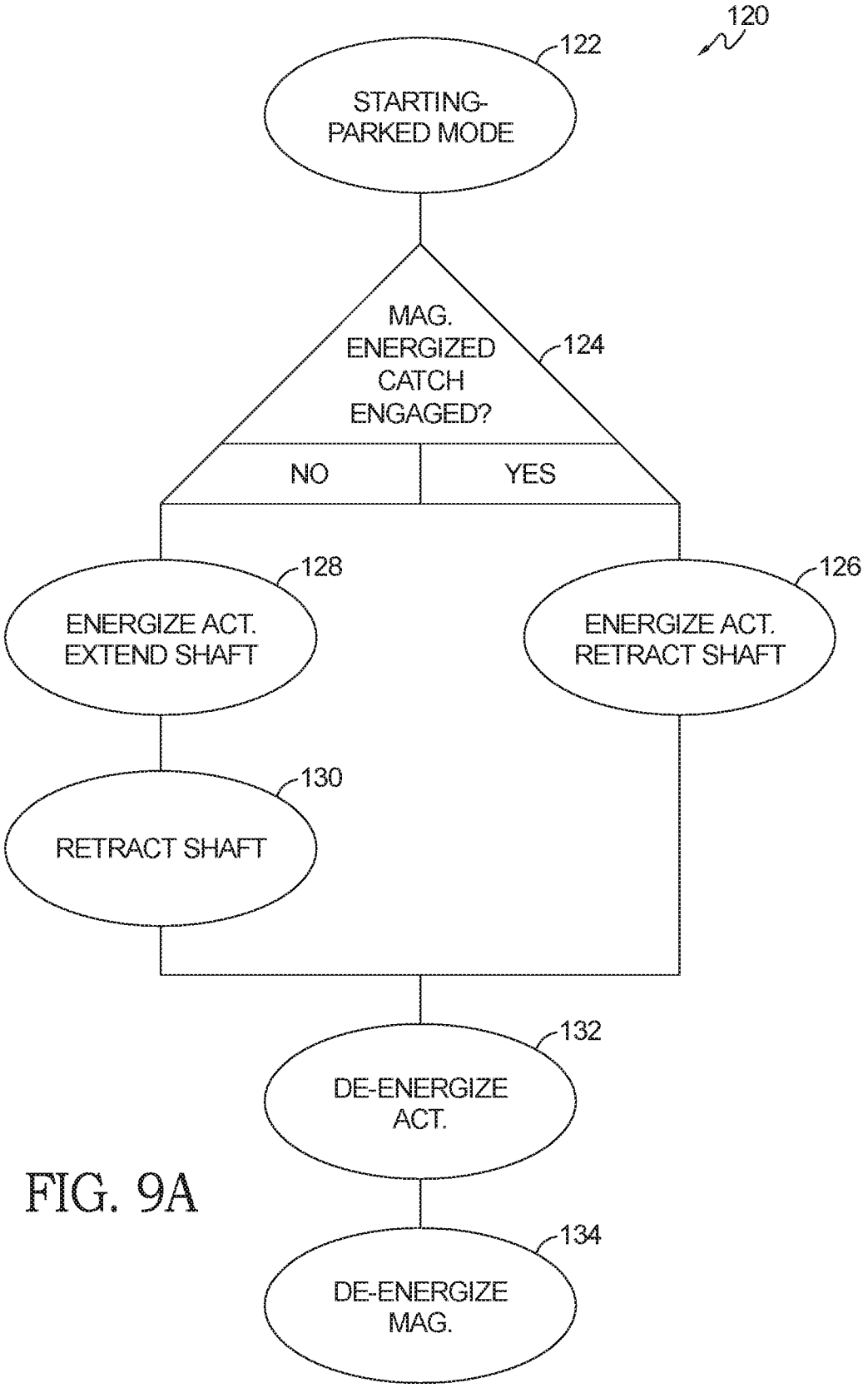
FIG. 9A is a flow chart depicting an alternate method for completing an unlocking cycle in accordance with the invention.

Referring to FIG. 9A, a method 120 for completing an unlocking cycle of dogging assembly 42' is shown. In a first step 122 (starting-parked mode), the actuator 46 and electromagnet 48 are both de-energized and latch 14 is in its position following completion of a previous cycle. In a next step 124, electromagnet 48 is energized and sensor 67 determines whether magnet catch 66 is in touching contact with electromagnet 48 or not in touching contact with electromagnet 48. In a next step 126, if a determination is made that magnet catch 66 is in touching contact with electromagnet 48, controller 252, 252' energizes actuator 46 and causes actuator shaft 47 and lead block 54 and latch 14 to retract and bringing armature 43 in contact with electromagnet 48. At this point, the dogging portion of the unlocking cycle is completed. If in step 124 a determination is made that magnet catch 66 is not in touching contact with electromagnet 48, in step 128, controller 252, 252' energizes actuator 46 and causes actuator shaft to extend bringing magnet catch 66 in touching contact with electromagnet 48. In a step 130 subsequent to step 128, after confirmation is made that magnet catch 66 is in touching contact with electromagnet 48, controller 252, 252' causes actuator shaft 47 and lead block 54 to retract. In a next step 132, actuator 46 is de-energized to return shaft 47 and lead block 54 to their starting-parked positions. Upon completion of step 132, the dogging portion of an unlocking cycle is completed. In a final step 134, electromagnet 48 is de-energized releasing armature 43 and returning latch 14 to its extended position. At this point, the full unlocking cycle is completed and latch 14 is returned to its latched, extended position.

In accordance with another aspect of the present invention, it is desirable that, upon energizing of the actuator, full latch retraction is reached within a prescribed period such as, for example, 1.0 second or less after the actuator is energized. Actuator "slippage" or stalling occurs when the actuator is prevented from moving when it should be moving and is usually caused by high resistive force within the latch mechanism opposing latch retraction.

To address slippage of a stepper motor type actuator, encoder 250 (FIG. 10A) may be coupled with the actuator to detect the onset of slippage. An encoder is a real-time closed-loop sensor known in the art that measures the angular steps taken by the output shaft of the stepper motor, over time, to detect instantaneous motor slippage. When encoder 250 senses that actuator slippage is occurring by a noted change in the angular steps taken over time, a feedback signal 251 is sent to controller 252 to decrease the input signal frequency to the stepper motor, thereby increasing the torque output of the stepper motor to complete latch retraction.

For example, if the stepper motor is designed to index 1000 steps in order to fully retract the latch and the controller is set to command the stepper motor to index 1000 steps in one second, in the event the controller senses that 1000 steps have not been taken by the motor in one second (i.e., the latch is not fully retracted within 1 second) the controller would interpret this as a latch binding condition. The controller 252 would then reduce the motor indexing rate by reducing the input frequency 253 to the motor. By reducing the input frequency, output torque of the motor would be increased to overcome the binding condition. The controller may reduce the indexing rate from 1000 steps/second to, say, 1000 steps/1.5 seconds to fully retract the latch. If, after one or more tries of reducing the indexing rate, the controller does not sense 1000 steps have been reached (i.e., the latch has not been fully retracted), an alarm (visual or audible) may be set off, signally a malfunctioning latch mechanism.

In the alternative, rather than encoder 250 being used to detect slippage in closed-loop fashion, motor slippage may be detected directly by measuring latch travel over time once actuator 46 is energized. A latch travel sensor in the form of a switch 254, shown schematically in FIG. 10B, such as, for example, a micro switch, may be positioned next to latch 14 to trigger a signal to controller 252' upon detecting when latch 14 has reached full retraction. In the above example, if full latch retraction within 1 second has not been detected, controller 252' may decrease the input signal frequency to a stepper motor, or increase voltage or current to a DC brush motor, thereby increasing the torque output of the motor to complete latch retraction. Further in the alternative, when coupled to latch dogging assembly 42 described above, full latch retraction may be detected by determining when armature 43 comes in contact with electromagnet 48 by measuring the magnet force between armature 43 and electromagnet 48 or by measuring the position of the electromagnet relative to the armature using a hall effect sensor or a mechanical switch. If full latch retraction within 1 second has not been detected, in the case of a stepper motor actuator, controller 252' may decrease the input signal frequency to the stepper motor, thereby increasing the torque output of the stepper motor to complete latch retraction. In the case where a DC brush motor is used instead of a stepper motor, controller 252' may increase voltage or current to the motor when the latch fails to reach full retraction.

Figure 10A:
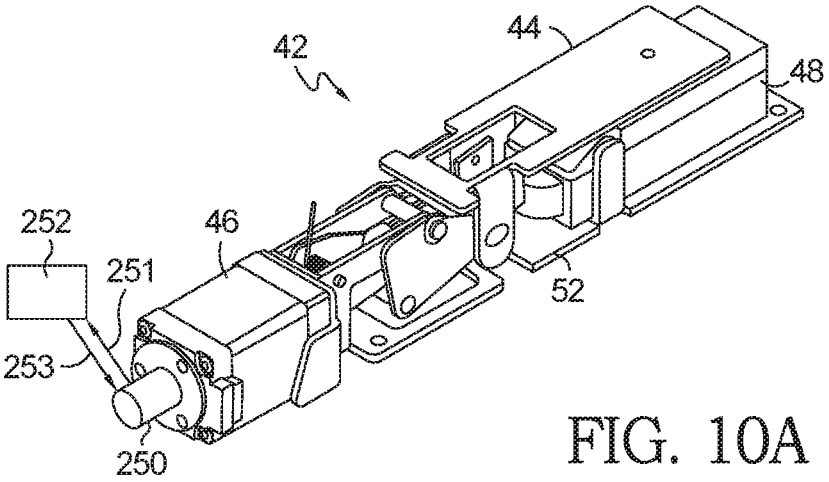
FIG. 10A is a perspective view of the latch dogging assembly, showing a schematic closed-loop circuitry, in accordance with an embodiment of the invention.
Figure 11:
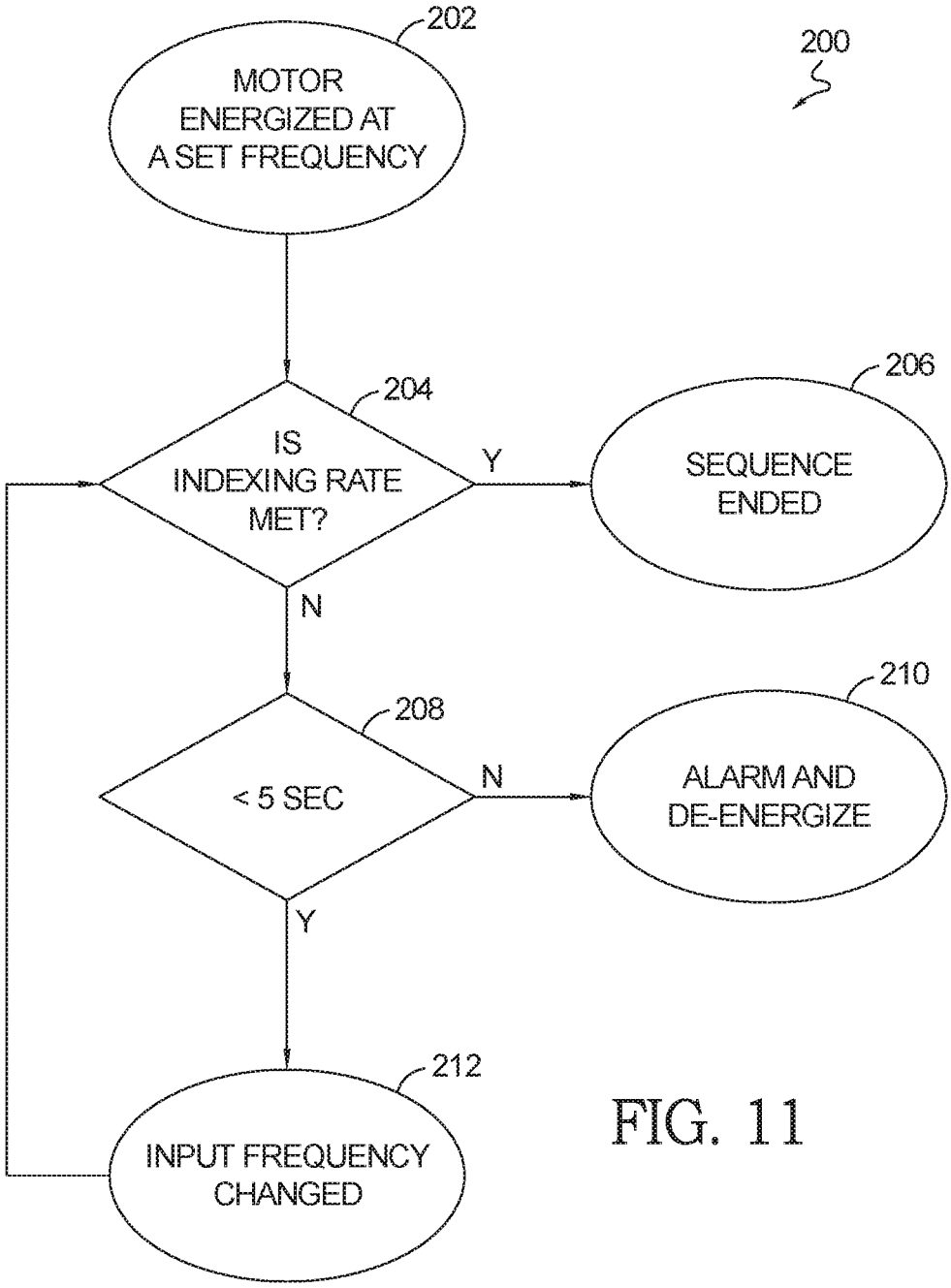
FIG. 11 is a flow chart depicting a closed loop method of detecting latch binding and for making corrections to fully retract the latch in accordance with an embodiment of the invention.

Referring to FIGS. 10A and 11, a closed-loop slippage detection sequence 200 for detecting binding of the latch and for making corrections to fully retract the latch is shown. At step 202, actuator 46 is energized. Actuator may be a stepper motor. At step 204, controller 252 inquires whether full retraction of the latch has been reached within a prescribed interval of time, say within 1 second. If encoder 250 signals that full latch retraction has been reached within 1 second, the slippage detection sequence is ended at step 206. At step 204, if full latch retraction is not signaled within 1 second, at step 208, controller 252 determines whether a second prescribed interval of time has passed since the actuator was first energized, say 5 seconds. If 5 seconds have passed, at step 210, controller shuts off power to the actuator and optionally sets off an alarm (visual or audible) signally a malfunctioning latch mechanism. If, at step 208, 5 seconds have not passed since the actuator was first energized but full latch retraction has not been reached, at step 212, input frequency to the stepper motor is incrementally decreased so as to increase output toque of the motor. From step 212, the sequence loops back to step 204. In this step, if full latch retraction is detected within the next second or so, the slippage detection sequence is ended at step 206. If full latch retraction is not detected, the sequence proceeds to step 208 until step 206 or step 210 is reached.

The above sequence 200 describes a closed loop sequence for detecting binding of the latch and for making corrections to fully retract the latch. In another aspect of the invention, when either a stepper motor or a DC brush motor is used as the actuator, an open loop sequence 300 may be used to compensate for a binding latch. That is, a separate sensor 254, which may be for example a micro switch, a magnetic force sensor or a Hall Effect sensor, is needed to complete the sequence.

Figure 10B:
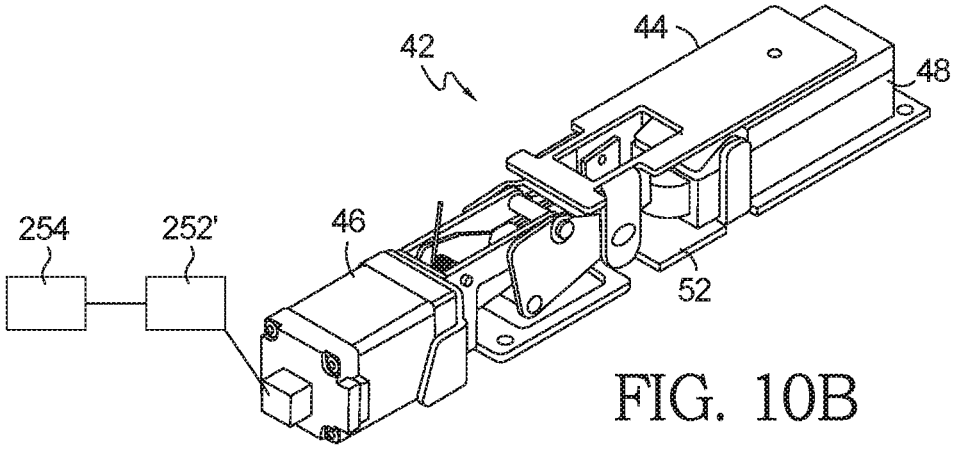
FIG. 10B is a perspective view of the latch dogging assembly, showing a schematic closed-loop circuitry, in accordance with an embodiment of the invention.
Figure 12:
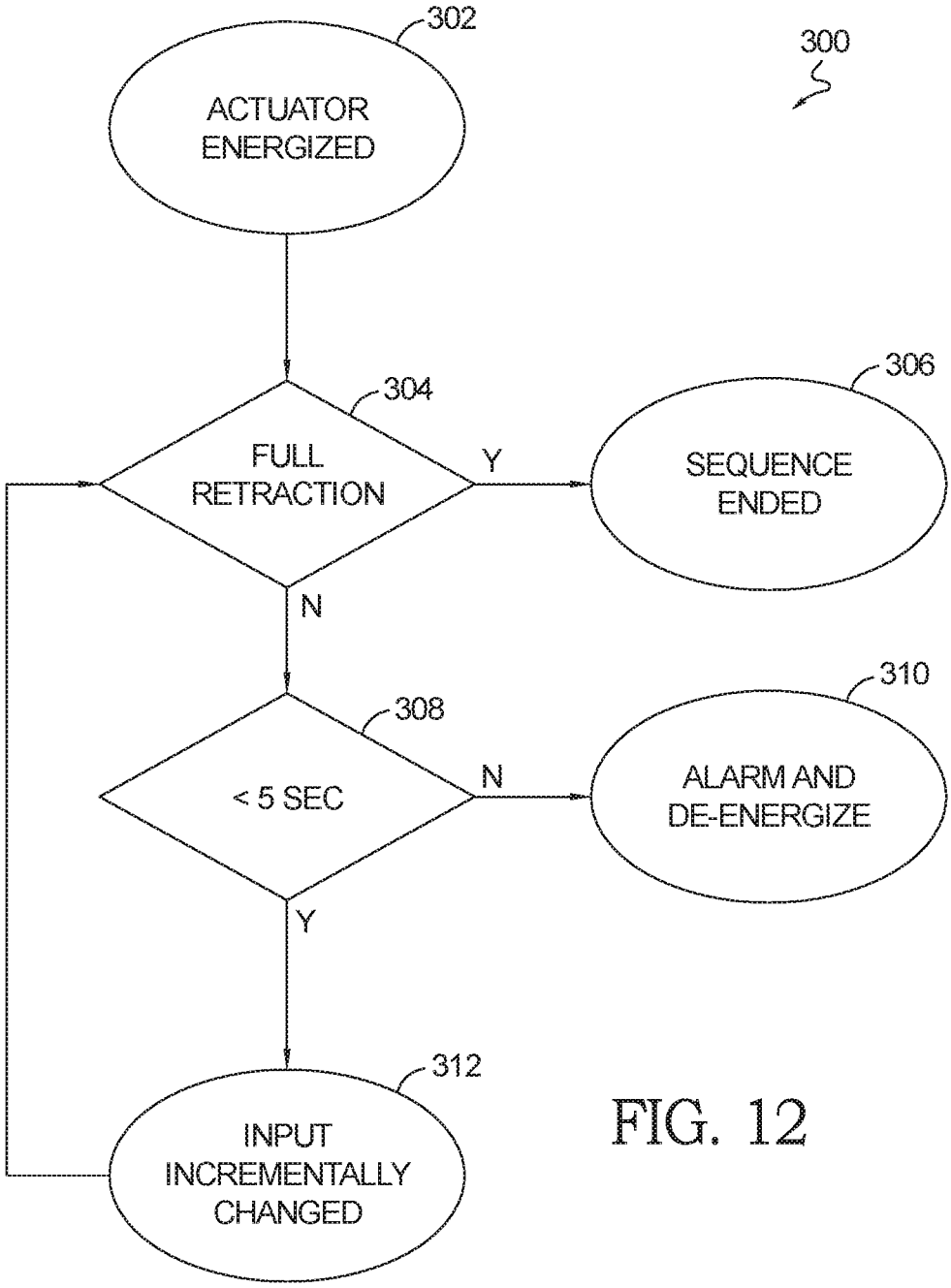
FIG. 12 is a flow chart depicting an open loop method of detecting latch binding and for making corrections to fully retract the latch in accordance with an embodiment of the invention.

Referring to FIGS. 10B and 12, open loop sequence 300 is shown. At step 302, motor 46 is energized at a predetermined supply input (input frequency, input voltage or input current). At step 304, sensor 254 determines whether full latch retraction has been reached within a prescribed period such as, for example, 1 second. If full latch retraction has been reached within the prescribed period, the open loop slippage detection sequence is ended at step 306. At step 304, if sensor 254 determines that full latch retraction has not been reached within the prescribed period, then, at step 308, controller 252' determines whether a second time interval has passed since the motor was first energized, say greater than 5 seconds. If the second time interval has passed, at step 310, controller shuts off power to the motor and optionally sets off an alarm (visual or audible) signally a malfunctioning latch mechanism. If, at step 308, the second time interval has not passed since the motor was first energized, at step 312, input frequency to a stepper motor is incrementally reduced, or input voltage or input current to a DC brush motor is incrementally increased, thereby increasing motor torque output. From step 312, the sequence loops back to step 304. If in this step, full latch retraction is detected, the open-loop slippage detection sequence is ended at step 306. If full latch retraction is not detected, the open loop sequence proceeds to step 308 until step 306 or step 310 is reached.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A method for adjusting input to a door latch actuator by a controller in order to retract a door latch, wherein said door latch actuator is a stepper motor and includes a sensor for detecting door latch binding, said method comprising the steps of:

a) actuating said door latch actuator at a first signal input frequency;

b) determining by said sensor whether said door latch has retracted within a first predetermined time limit after actuating said door latch actuator;

wherein, if said door latch has not retracted within said first predetermined time limit, c) decreasing said first signal input frequency to said door latch actuator to a second signal input frequency;

d) increasing an output torque of said door latch actuator based on said second signal input frequency; and e) causing further retraction of said door latch by said increased output torque.

2. The method in accordance with claim 1 wherein, if said door latch has not retracted within a second predetermined time limit after actuating said door latch actuator, the method further comprises initiating an audible or visible alarm.

3. A method for adjusting input to a latch actuator by a controller in order to fully retract a door latch, wherein said latch actuator is a stepper motor, said method comprising the steps of:

a) energizing said stepper motor at a predetermined input frequency, wherein said predetermined frequency corresponds to a predetermined motor indexing rate;

b) measuring an actual motor indexing rate;

c) comparing said actual motor indexing rate to said predetermined motor indexing rate; and d) reducing an input frequency if said actual motor indexing rate is less than said predetermined motor indexing rate to fully retract the door latch.

4. A method for adjusting input to a door latch actuator by a controller in order to fully retract a door latch, wherein said door latch actuator is a stepper motor and includes a sensor for detecting door latch binding, said method comprising the steps of:

a) actuating said door latch actuator;

b) determining by said sensor whether said door latch has retracted within a predetermined time limit after actuating said door latch actuator;

wherein, if said door latch has not retracted within said predetermined time limit, c) changing actuating input to said door latch actuator without deactivating the door latch actuator to cause full retraction of said door latch.

5. A method for adjusting input to a door latch actuator by a controller in order to fully retract a door latch, wherein said door latch actuator is a stepper motor and includes a sensor for detecting door latch binding, said method comprising the steps of:

a) placing said door latch actuator in an actuating mode;

b) determining by said sensor whether said door latch has retracted within a predetermined time limit while said door latch actuator is in said actuation mode;

wherein, if said door latch has not retracted within said predetermined time limit, c) decreasing signal input frequency to said door latch actuator and maintaining said door latch actuator in said actuation mode;

d) increasing an output torque of said door latch actuator by said decreased signal input frequency; and e) causing full retraction of said door latch by said increased output torque.

6. A method for adjusting input to a door latch actuator by a controller in order to fully retract a door latch, wherein said door latch actuator is a stepper motor and includes a sensor for detecting door latch binding, said method comprising the steps of:

a) actuating said door latch actuator to impart a first output torque to retract said door latch;

b) determining by said sensor whether said door latch has retracted within a predetermined time limit after actuating said door latch actuator;

wherein, if said door latch has not retracted within said predetermined time limit, c) decreasing signal input frequency to said door latch actuator so that door latch actuator imparts a second output torque causing full retraction of said door latch, wherein said second output torque is greater than said first output torque.

7. The method in accordance with claim 1 wherein step c) is performed without terminating power to said door latch actuator.

8. The method in accordance with claim 1 wherein said second signal input frequency is less than said first signal input frequency and greater than zero.

9. The method in accordance with claim 1 further comprising:

determining by said sensor whether said door latch has retracted within a second predetermined time limit after actuating said door latch actuator, wherein said second predetermined time limit is greater than said first predetermined time limit; and shutting off power to said door latch actuator if said door latch has not retracted within said second predetermined time limit after actuating said door latch actuator.

10. The method in accordance with claim 9 wherein, if said door latch has not retracted within said second predetermined time limit after actuating said door latch actuator, the method further comprises initiating an audible or visible alarm indicating that said door latch is malfunctioning.

* * * * *